United States Patent [19]

Penrod

[11] 4,121,658

[45] Oct. 24, 1978

[54] PITLESS WELL ADAPTER

[75] Inventor: Bernice Benjamin Penrod, Tipp City, Ohio

[73] Assignee: Dayton Precision Manufacturing Company, Dayton, Ohio

[21] Appl. No.: 815,573

[22] Filed: Jul. 14, 1977

[51] Int. Cl.[2] ..... E21B 33/03

[52] U.S. Cl. ..... 166/85; 285/39; 285/140

[58] Field of Search ..... 166/85, 88, 89; 285/39, 285/140

[56] References Cited

U.S. PATENT DOCUMENTS

| | | | |
|---|---|---|---|
| 2,998,847 | 9/1961 | Maass | 166/85 |
| 3,161,424 | 12/1964 | Maass | 166/85 |
| 3,183,973 | 5/1965 | Eging | 166/85 |
| 3,270,818 | 9/1966 | Pugh, Jr. | 166/85 |
| 3,430,697 | 3/1969 | Wellstein | 166/85 |
| 3,563,310 | 2/1971 | Wellstein | 166/85 |

*Primary Examiner*—Ernest R. Purser
*Attorney, Agent, or Firm*—Biebel, French & Nauman

[57] ABSTRACT

A pitless well adapter is provided having a main body portion with vertical and horizontal openings which are interconnected through the main body to provide a passageway for water from the well into a horizontal supply pipe. The adapter is secured in a well casing so that the horizontal opening is in registry with a hole in the side of the casing, and an outer connector member is secured around the outside of the casing to provide a means for connecting the horizontally extending pipe. The main body of the adapter is held in position inside the casing by thrust developed between the adapter and opposite sides of the casing wall. A pair of lever arms are pivotally interconnected and mounted on the main body opposite the horizontal opening with an end portion of one of the lever arms being secured to the main body and an end portion of the other lever arm being secured to a slide member mounted for vertical sliding movement on the main body and engaged with a threaded member rotatably mounted in the main body. Rotation of the threaded member causes the lever arms to be pivoted outwardly away from the main body so as to engage the side of the casing and develop thrust holding the main body in position.

7 Claims, 6 Drawing Figures

PITLESS WELL ADAPTER

BACKGROUND OF THE INVENTION

The present invention relates to pitless well adapters, which are used to form the connection between a horizontal supply pipe to a house or the like and the vertical well pipe in the ground.

It is necessary that the adapter be positionable within the casing at a sufficient distance below the surface of the ground to prevent freezing of water in the supply line. Since the actual position of the adapters relative to the casing can not be determined until the casing is in the ground, it is necessary that such adapters can be positioned in the casing after the casing has been installed. In order to do this, some means of securing the adapters in position in alignment with the horizontal supply pipe must be utilized.

A common expedient for securing the main body portion of the adapter within the well casing is the use of a lever member that can be moved outwardly from the main body portion on the side opposite the position of the hole in the casing through which the water supply line is connected. Such lever members engage the side of the casing and force the main body portion against the inside wall of the casing adjacent the hole therein. Seals are also generally provided around the hole in the casing between the inside wall of the casing and the corresponding surfaces of the adapter in order to prevent leakage from the adapter and to prevent contamination of the well from the ground around the hole in the casing.

A variety of mechanisms have been devised to provide controlled movement of such lever members for engagement with the casing after the adapter is properly positioned in registry with the hole on the side of the casing, typical examples being disclosed in the U.S. Patents to Maass No. 2,998,847, Eging No. 3,183,973, Pugh No. 3,270,818 and Wellstein Nos. 3,430,697 and 3,563,310.

SUMMARY OF THE INVENTION

The present invention provides an improvement in such lever members for holding the main body portion of a pitless well adapter in position in a well casing.

This is accomplished by providing a pitless well adapter of the type having a downwardly directed opening and a laterally directed opening with a fluid passage through the main body portion providing communication between the openings, an outer connector member with an opening disposable in registry with the laterally directed opening of the main body portion and in alignment with the hole in the casing, the outer connector member being adapted for receiving a supply pipe in communication with the opening in the connector to supply water from the well to a house or the like, and means for removably securing the outer connector member and the main body portion to the casing in registry with the hole.

The means for securing the main body portion in the casing basically comprises a pair of lever arms disposed alongside the main body portion opposite the lateral opening therein and having one end portion of each of the lever arms pivotally interconnected, and means pivotally connecting the other ends of the pair of lever arms to the main body portion so that the interconnected end portions are moved away from the body portion whereby at least one of the lever arms will engage the casing opposite the hole therein and thereby develop a thrust force effective to maintain the main body portion of the adapter in position. The connecting means is adjustably positionable so as to permit the position of the lever arms and their force against the casing to be varied.

It is preferable that the end of one of the lever arms opposite the interconnected ends be pivotally secured to the main body portion while the opposite end of the other lever arm is secured to a slide member movable vertically along a surface of the main body portion. The slide member is threadably engaged with a screw member rotatably mounted in the main body portion so that rotation of the screw member causes the slide member to move vertically and thus causes the interconnected end portions of the lever arms to move outwardly to engage the inner wall of the casing.

It is also desirable to have one of the interconnected end portions of the lever arms extend outwardly beyond the interconnected end portion of the other lever arm so that when the interconnected end portions are moved outwardly against the casing wall, the one which extends beyond the other engages the wall.

DETAILED DESCRIPTION OF THE PREFERRED EMBODIMENT

Figure 1:
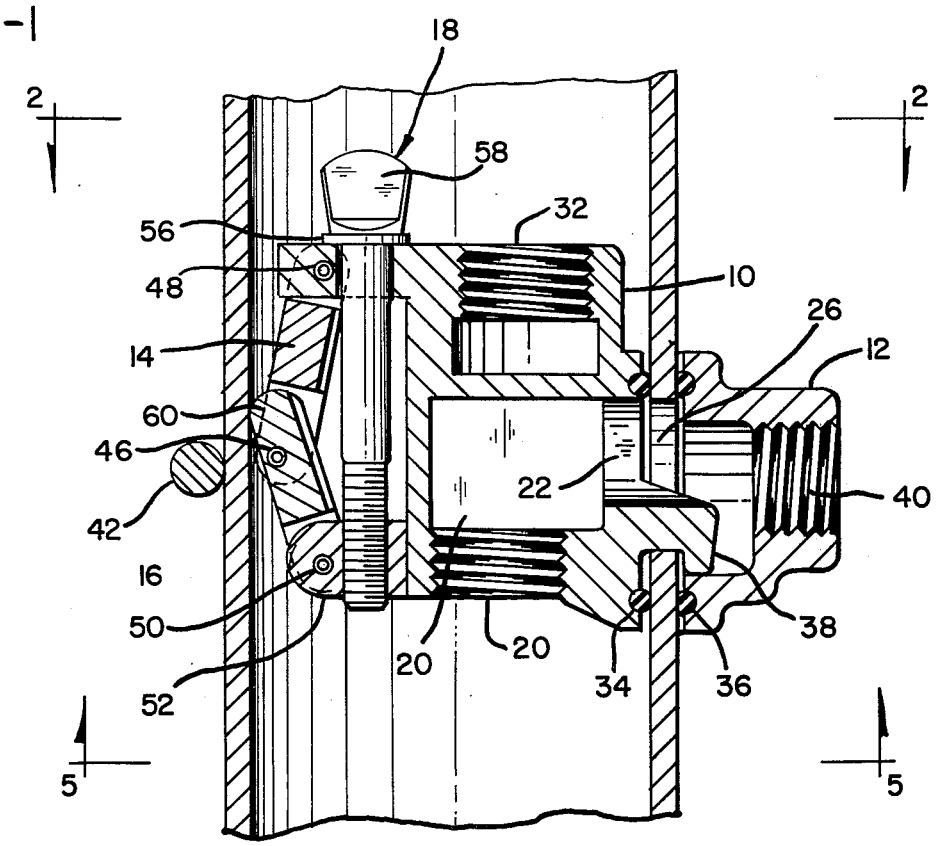
FIG. 1 is a section on the line 1—1 of FIG. 2 showing the preferred embodiment of the present invention located in a well casing.
Figure 2:
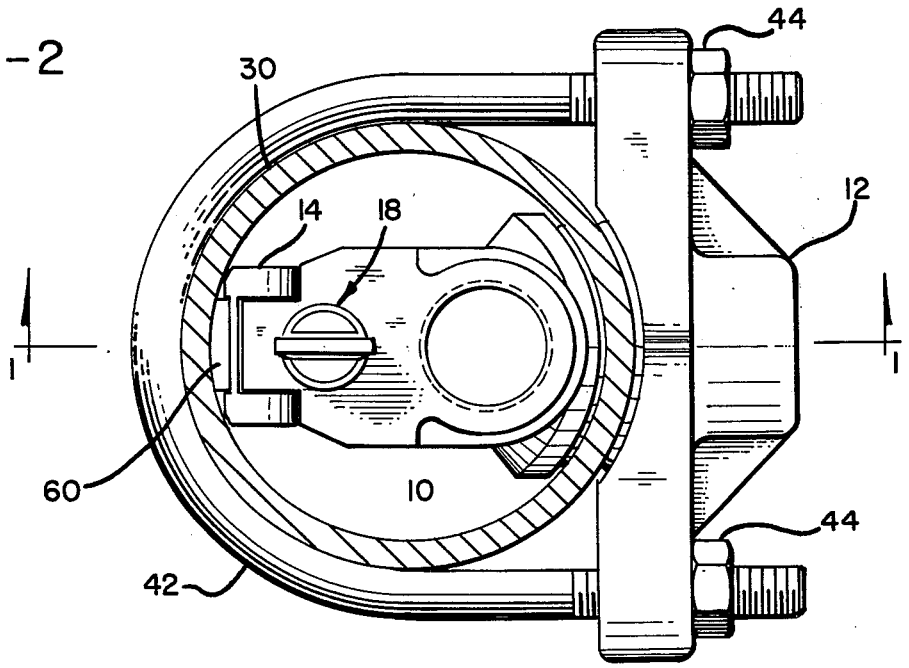
FIG. 2 is a section on the line 2—2 of FIG. 1.

The preferred embodiment of the pitless well adapter of the present invention is best illustrated in FIG. 1 as basically comprising a main body portion 10, an outer connector member 12, a pair of lever arms 14 and 16, and a screw member 18. The main body portion 10 is a casting having a downwardly extending opening 20 and a laterally extending opening 22 which are interconnected through a passageway 24. Opening 20 is provided with threads to connect to a pipe coming from the well pump (not shown), and opening 22 is disposed in registry with a hole 26 defined in the well casing 30.

A threaded blind hole 32 is preferably formed in the top of the main body portion 10 of the adapter to accommodate a pipe (not shown) used to lower the adapter into the casing to a position in registry with hole 26. This opening 32 is not in communication with the passageway 24 and provides only a means for attaching the pipe which lowers the main body portion into the well. The pipe used to lower the main body portion into the well can remain in place.

O-ring type seals 34 and 36 are respectively provided in recesses formed in the adjacent surfaces encompassing the hole 26 in the casing 30 so as to provide a water tight seal between the main body portion 10 and the inner wall of well casing 30 and between the outer connector member 12 and the outer wall of casing 30. A lip 38 on the lower edge portion of the opening 22 extends through the hole 26 and rests on the lower portion thereof in order to locate the main body portion 10 in registry with the hole 26 when the main body portion is lowered into the well casing 30.

Outer connector member 12 is provided with an opening 40 extending entirely therethrough which can be placed in communication with the opening 22 in the main body portion 10 when the main body portion and outer connector member are in alignment with the hole 26. The outer end portion of opening 40 is threaded in order to provide a means for connecting a water supply pipe (not shown) which is utilized to supply water from the well to a house or the like.

The outer connector member 12 is preferably secured in position by a U-bolt 42 which surrounds the well casing 30 and engages the outer connector member 12. Corresponding holes are provided in member 12 through which the threaded end portions of U-bolt 42 are inserted. With nuts 44 secured to the threaded end portions of U-bolt 42, the outer connector member 12 will be pressed against the outer wall of casing 30 so that seal 36 sealingly engages the wall and holds outer connector member 12 in alignment with hole 26.

Figure 5:
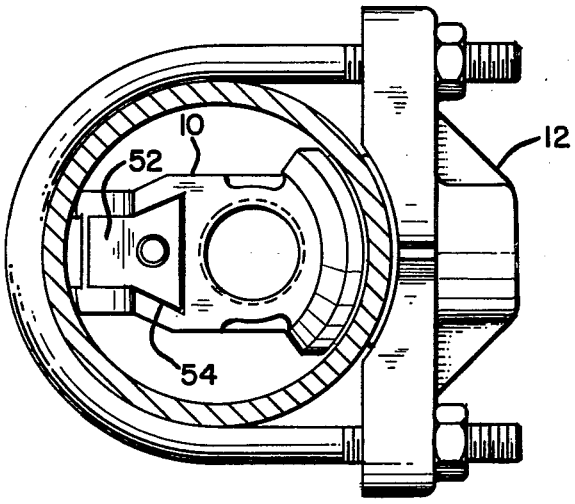
FIG. 5 is a section on the line 5—5 of FIG. 1.
Figure 6:
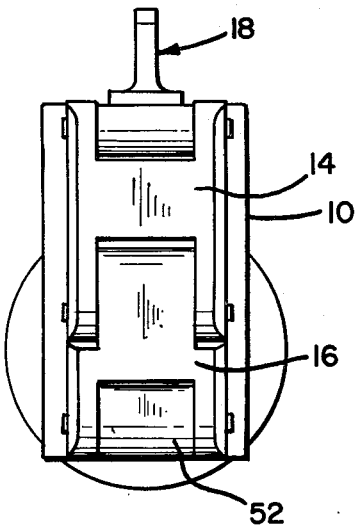
FIG. 6 is an end elevational view of the main body portion of the preferred embodiment looking in the direction of the lever arm.

Lever arms 14 and 16 are pivotally interconnected by pin 46 at their one end portions. Lever arm 14 is pivotally connected by pin 48 at its other end portion to the main body portion 10, and lever arm 16 is pivotally connected by pin 50 to a slide member 52. Slide member 52 is disposed in a dove-tail cross section channel 54 defined in the main body portion, as best seen in FIG. 5, which permits slide member 52 of corresponding shape to be moved vertically a sufficient amount to permit lever member 16 to engage the inner wall of casing 30.

Slide member 52 is threadably engaged with the lower threaded end portion of screw member 18 so that rotation of screw member 18 causes the slide member 52 to move vertically in the channel 54. The screw member 18 is rotatably mounted in the upper end portion of main body portion 10 and has an upper shoulder 56 which rides on an upper surface of the main body portion when the screw member 18 is rotated. A generally rectangular cross sectioned upper portion 58 of screw member 18 is provided so that a corresponding mating tool (not shown), such as a flattened end portion of a pipe, can be placed over the end portion 58 to rotate the screw 18.

Referring again to lever arm 16, it is preferably so connected to lever arm 14 that the outermost end portion 60 extends in an arc beyond the outermost interconnected end portion of lever arm 14 so that only the outermost end portion 60 engages the inner wall of casing 30. Also, the outermost end portion of lever arm 16 can be of transverse rectangular cross section or have an arcuate outer surface of the same diameter of the inside of casing 30. If it has a rectangular cross section, it will engage the inside surface of the wall at two spaced locations, whereas if an arcuate outer surface is used, it will have continuous surface to surface contact.

In operation, after the well casing 30 has been placed in position, the hole 26 is cut into the side of the well casing at a distance below the freeze line of the ground where the well is installed. The outer connector member 12 is then secured in position by tightening the U-bolt 42 about the outside of the casing so as to engage the outer wall of the casing through O-ring 36. The supply pipe (not shown) can then be connected to the outer connector member 12 and the dirt filled back in around the well casing 30 and the water supply pipe.

The main body portion 10 of the adapter can then be lowered down into the casing from above ground with a pipe (not shown) inserted in opening 32, and positioned in alignment with the hole 26 in casing 30 so that lip 38 rests on the lower edge of hole 26. With the adapter held in this position, a tool, such as a partially flattened section of pipe, is then lowered down the well casing and engaged with the upper portion of screw member 18.

Figure 3:
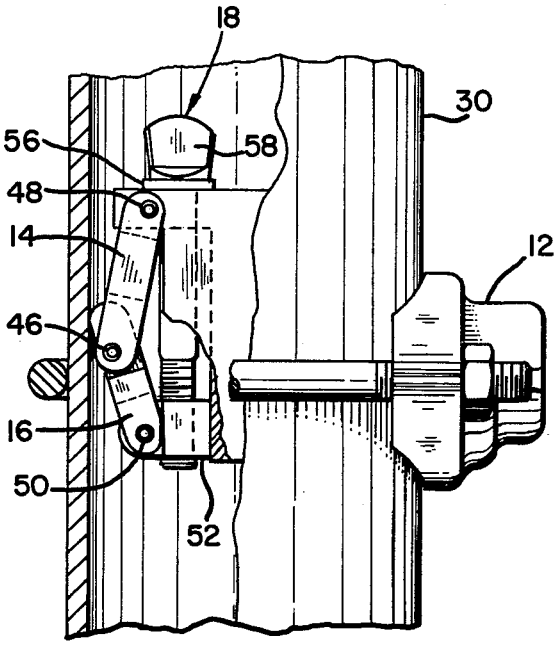
FIG. 3 is a partially cut away side view of the embodiment of FIG. 1 showing a lever arm in engagement with the casing.
Figure 4:
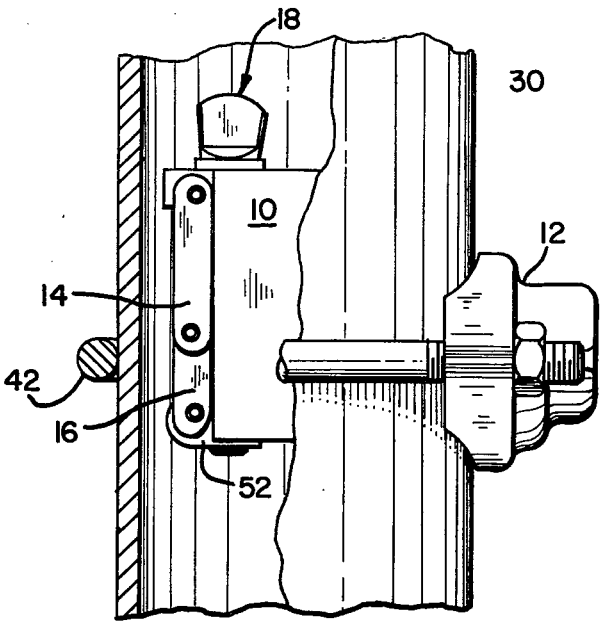
FIG. 4 is a view similar to FIG. 3 showing the lever arms in the position they are in when the main body portion is being inserted in a well casing, before the lever arms have been extended to engage the side wall of the casing.

When the main body portion is lowered into the casing, the lever arms 14 and 16 are positioned as illustrated in FIG. 4, but upon rotation of screw member 18, the lever arms extend to the position illustrated in FIG. 3 so that the outermost portion 60 of lever arm 16 engages the inner wall of casing 30. In this position, the main body portion 10 is urged laterally towards opening 26 so as to force the seal 34 to engage the inner wall of casing 30 about hole 26 and hold the main body portion 10 in that position.

The tool is then removed, and the adapter will remain in position until it is desired to remove it. To remove the main body portion 10, the screw member 18 is simply rotated in the opposite direction, which causes lever arms 14 and 16 to retract from their position as shown in FIG. 3 to the position shown in FIG. 4.

While the form of apparatus herein described constitutes a preferred embodiment of the invention, it is to be understood that the invention is not limited to this precise form of apparatus, and that changes may be made therein without departing from the scope of the invention.

What is claimed is:

1. A pitless well adapter for securement in a well casing to provide a sealed connection to a pipe through a hole in the side of said casing, comprising:

a main body portion having a downwardly directed opening and a laterally directed opening with a fluid passage through said body portion connecting said openings;

an outer connector member having an opening disposable in registry with said laterally directed opening in alignment with said hole in said casing, said outer connector member being adapted for receiving said pipe in communication with the opening in said connector member;

means for securing said outer connector member to said casing in registry with said hole;

a pair of lever arms disposed alongside said main body portion opposite said lateral opening therein and having one end portion of each pivotally interconnected; and means connecting said pair of levers to said main body portion and pivotally secured to other end portions of said lever arms for causing relative pivotal movement between said lever arms so that said interconnected end portions will move away from said body portion and at least one of said lever arms will engage said casing opposite said hole so as to maintain said adapter in position in said casing, said connecting means being adjustably positionable to provide for variation of the position of the lever arms and the engagement force thereof on the casing.

2. A pitless well adapter as defined in claim 1 wherein said pair of lever arms are pivotally interconnected so that an outermost portion of one of the interconnected end portions is pivoted outwardly beyond the interconnected end portion of the other of said lever arms thereby causing said outermost portion to engage said casing.

3. A pitless well adapter as defined in claim 1 wherein said connecting means includes:

screw means rotatably mounted in said main body portion and having an elongated threaded portion;

movable means engaging said threaded portion of said screw means and movable therealong upon rotation of said screw means;

means pivotally connecting one of said other end portions of said lever arms to said main body portion; and means pivotally connecting the other of said other end portions to said movable means so that rotation of said screw means causes relative pivotal movement of said lever arms.

4. A pitless well adapter as defined in claim 3 wherein said movable means includes a slide member captive in a channel defined in said main body portion so as to be in axial alignment with said casing, said lever arms being connected at all end portions for pivotal movement about axes transverse to said casing axis.

5. A pitless well adapter for securement in a well casing to provide a sealed connection to a pipe through a hole in the side of the casing, comprising:

a main body portion having a downwardly directed opening and a laterally directed opening with a fluid passage through said body portion connecting said openings;

an outer connector member having an opening disposable in registry with said laterally directed opening in alignment with said hole in said casing, said outer connector member being adapted to receive said pipe in communication with the opening in said connector member;

means for securing said outer connector member in engagement with said casing in registry with said hole;

a pair of lever arms disposed alongside said main body portion opposite said lateral opening therein and having one end portion of each pivotally interconnected, one of said pair of lever arms being pivotally secured to said main body portion;

means mounted on said main body portion and adjustably positionable in a plane parallel to the longitudinal axis of said casing, another of said lever arms having an end portion pivotally secured to said adjustably positionable means for movement therewith so that said interconnected end portions will move outwardly away from said main body portion in such a manner that at least one of said interconnected end portions will engage the inner wall of said casing and thereby maintain said adapter in position; and screw means rotatably mounted in said main body portion and in threaded engagement with said adjustably positionable means such that said adjustably positionable means will move along said screw means upon rotation thereof so as to cause pivotal movement of said lever arms.

6. A pitless well adapter as defined in claim 5 wherein said pair of lever arms are pivotally interconnected so that an outermost portion of one of the interconnected end portions is pivoted outwardly beyond the interconnected end portion of the other of said lever arms thereby causing said outermost portion to engage said casing.

7. A pitless well adapter as defined in claim 5 wherein said adjustably positionable means includes:

a slide member in threaded engagement with said screw means and captive in a channel formed in said main body portion for movement longitudinally of said casing.

* * * * *